US007734225B2

(12) United States Patent
Mashtare et al.

(10) Patent No.: US 7,734,225 B2
(45) Date of Patent: Jun. 8, 2010

(54) TRI-LEVEL TANDEM XEROGRAPHIC ARCHITECTURE USING REDUCED STRENGTH TONER

(75) Inventors: Dale R. Mashtare, Bloomfield, NY (US); Martin E. Banton, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 637 days.

(21) Appl. No.: 11/692,411

(22) Filed: Mar. 28, 2007

(65) Prior Publication Data

US 2008/0240788 A1 Oct. 2, 2008

(51) Int. Cl.
*G03G 15/01* (2006.01)
*G03G 15/08* (2006.01)

(52) U.S. Cl. ..... 399/223; 399/298; 399/299; 399/302

(58) Field of Classification Search ..... 399/223, 399/231, 232, 298, 299, 302
See application file for complete search history.

(56) References Cited

U.S. PATENT DOCUMENTS 5,155,541 A 10/1992 Loce et al.
5,337,136 A 8/1994 Knapp et al.
5,837,408 A * 11/1998 Parker et al. ..... 399/232
5,895,738 A 4/1999 Parker et al.
6,163,672 A 12/2000 Parker et al.
6,188,861 B1 2/2001 Parker et al.
6,203,953 B1 3/2001 Dalal
6,295,431 B1 9/2001 Mashtare et al.
7,277,649 B2 * 10/2007 Hirobe et al. ..... 399/223

* cited by examiner

*Primary Examiner*—William J Royer
(74) *Attorney, Agent, or Firm*—Oliff & Berridge, PLC

(57) ABSTRACT

A xerographic system and method use a tri-level development process in which at least one xerographic imaging unit includes a photoreceptor and a pair of developer units. A first developer unit includes a full strength toner of a given color and a second developer unit includes a reduced strength toner of the same or substantially the same color. By use of the tri-level process, excellent color-to-color registration can be achieved for each processed color separation. Moreover, by use of two strengths of the same colorant, a tighter control of a tone reproduction curve can be achieved. Additional xerographic imaging units can include a developer unit that provides spot color, custom color or specialty color capabilities. Additional benefits and gamut expansion can be achieved through use of a tandem architecture. A preferred implementation uses a four drum, eight color tandem architecture with full strength and reduced strength toners formulations of Cyan, Magenta, Yellow, and Black (CYMK) colorant.

20 Claims, 7 Drawing Sheets

TRI-LEVEL TANDEM XEROGRAPHIC ARCHITECTURE USING REDUCED STRENGTH TONER

BACKGROUND

A novel xerographic system architecture affords the opportunity to achieve improved color document image quality and consistency through use of a tri-level process and a reduced strength colorant.

SUMMARY

Color image quality is inherently limited in conventional xerography platforms. For example, image noise occurring in the xerographic process is concentrated in the midtone and highlight regions and coincides with a high level of visual sensitivity in this region.

Photographic quality inkjet printers have, for a number of years, taken advantage of light colorant strength ink capability to significantly drive down image noise levels for highlight/midtone areas, particularly for fleshtone and blue sky regions, for example. However, the ability to achieve a similar advantage with current xerographic platforms is difficult and not attractive due to color misregistration issues, product footprint, and other xerographic process limitations.

Tri-level processes have been used successfully in various commercial products, such as the Xerox 4850 and 4890 highlight color printers in which black and a spot color are formed. Similar tri-level processes have been described for use in full color copiers. Details of these tri-level processes can be found, for example, in U.S. Pat. Nos. 5,155,541 to Loce et al., 5,337,136 to Knapp et al., 5,895,738 to Parker et al., 6,163,672 to Parker et al., 6,188,861 to Parker et al., and 6,203,953 to Dalal, all assigned to Xerox Corporation and hereby incorporated by reference herein in their entireties.

The basics of tri-level processing use a single photoreceptor and a multi-level writing exposure, resulting in two image regions, one a charge area developable (CAD) region and the other a discharge area developable (DAD) region.

Aspects of the system take advantage of combining features of a number of advances in proven xerographic architectures, materials and process understanding with the potential of higher image quality than current electrophotographic systems in the market place. Aspects of the system enable flexibility to provide a customizable architecture that fits specific customer needs in color content and image quality.

In accordance with aspects of the disclosure, a tri-level process is used in a xerographic system in which at least one developer housing includes a full strength toner of a given color and a second developer housing includes a reduced strength toner of the same color. By strength of color, this refers, primarily to the colorant saturation levels of the toner material. Varied levels of saturation may be achieved through modifying the colorant pigment and/or dye concentration of the toner material. As an example, full colorant strength toners may be provided with about 5% by weight colorant pigment concentration, while a reduced colorant strength toner may contain on order of about 1% colorant pigment concentration. By use of the tri-level process, excellent color-to-color registration can be achieved for each processed color separation. Moreover, by use of two strengths of the same colorant applied in this manner, a tighter control of the tone reproduction curve can be achieved.

In accordance with exemplary embodiments, a four drum, eight color process having a tandem architecture is used. Developer units include full strength and reduced strength toners of Cyan, Magenta, Yellow, and Black (CYMK). However, the disclosure is applicable to other configurations and not limited to this.

In certain embodiments, at least one of the developer units may include a custom spot color.

In certain embodiments, at least one of the developer units may include a fifth process color.

In certain embodiments, at least one of the developer units may include one or more specialty toners, such as a clear toner or MICR toner or white pigmented toner.

BRIEF DESCRIPTION OF THE DRAWINGS

Exemplary embodiments will be described with reference to the attached drawings, in which like numerals represent like parts, and in which.

DETAILED DESCRIPTION OF EMBODIMENTS

Figure 1:
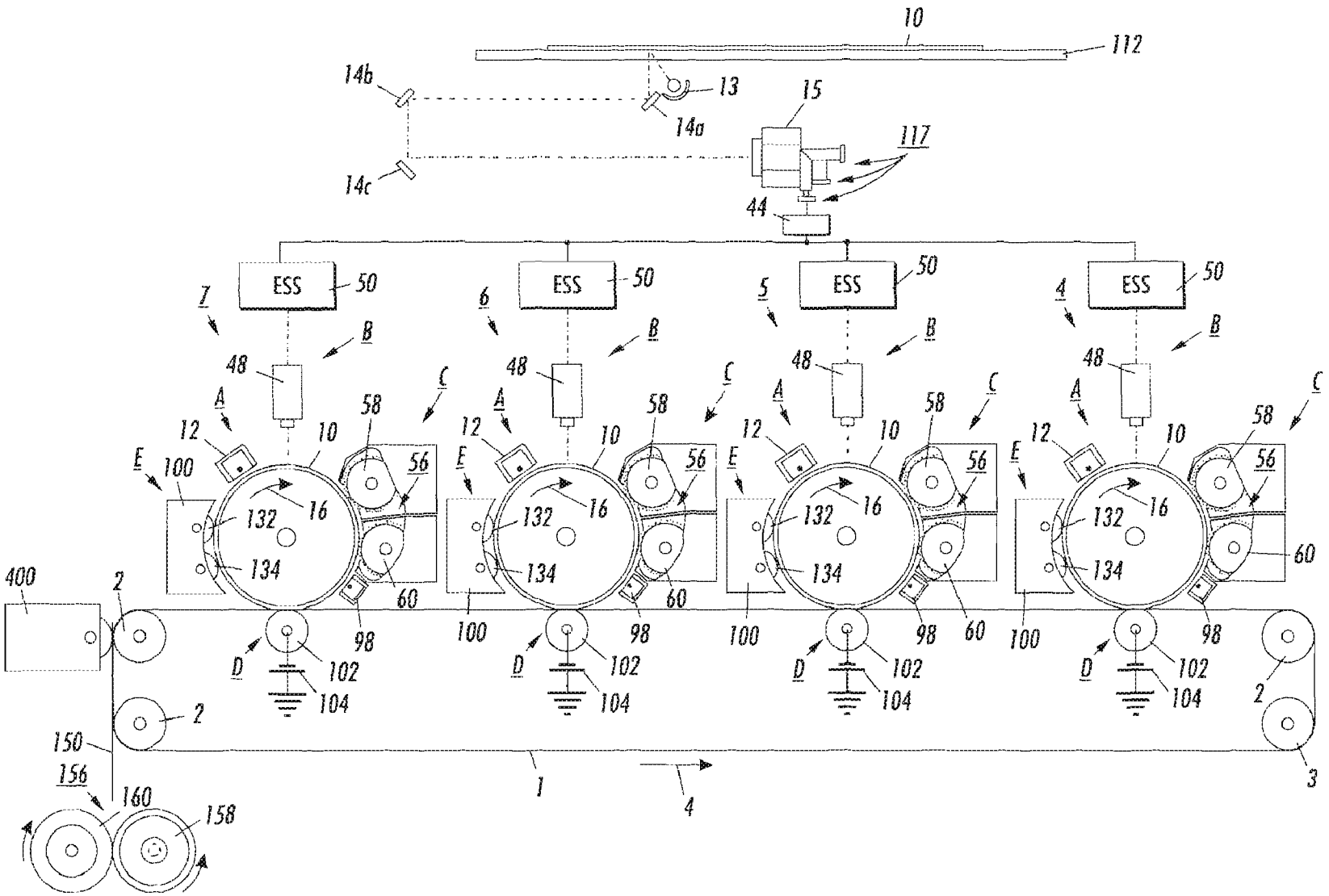
FIG. 1 is an illustration of an exemplary xerographic machine including a plurality of tri-level xerographic imaging units, at least one of which includes a full strength toner and a reduced strength toner of the same color.

A first embodiment of the disclosure will be described with reference to FIGS. 1-6. The basic xerographic system is shown and described in FIG. 1. This is a tandem architecture suitable for high-speed production color printing. Each photoreceptor develops two separations in tri-level mode. While they may be combined in different ways, the color separations are developed onto the various photoreceptors and then transferred to a compliant intermediate belt. When all four separations have been built up on the intermediate belt, the entire image is transfixed to paper. An optional film forming station can be used to spread out the toner image into a thin film before it is transfixed to paper.

Although described with reference to a digital color copy system, aspects of the disclosure could be used in a digital printing process in which a digital input original is derived from a computer/computer application.

In operation of the multicolor xerographic machine illustrated, a computer generated color image may be inputted into image processor unit 44 or a color document 10 to be copied may be placed on the surface of a transparent platen 112. A scanning assembly having a light source 13 illuminates the color document 10. The light reflected from the color document 10 may be reflected by mirrors 14*a*, 14*b* and 14*c*, through lenses (not shown) and a dichroic prism 15 to three charged-coupled devices (CCDs) 117 where the information is read. The reflected light can then be separated into three primary colors by the diachronic prism 15 and the CCDs 117. Each CCD 117 outputs an analog voltage, which is proportional to the strength of the incident light. The analog signal from each CCD 117 is preferably converted into a multi-bit digital signal for each pixel (picture element) by an analog/digital converter. The digital signal enters image processor unit 44. The output voltage from each pixel of the CCD 117 is stored as a digital signal in the image processor 44. The digital signal, which represents the blue, green, and red density signals is converted in the image processor 44 into bitmaps in a suitable color space, such as CYMK, which includes bitmaps for yellow (Y), cyan (C), magenta (M), and black (K). The bitmap represents the color value for each pixel of the image.

As illustrated in FIG. 1, the xerographic machine includes an intermediate belt 1 entrained about a plurality of rollers 2 and 3 and adapted for movement in the direction of the arrow 4. Belt 1 is adapted to have transferred thereon a plurality of toner images, which are formed using a plurality of tri-level image forming devices or engines 4, 5, 6 and 7. Each of the engines 4, 5, 6 and 7 can be identical except for the color of toners associated with each developer unit of the engine. Engine 4 includes a charge retentive member in the form of a photoconductive drum 10 constructed in accordance with well known manufacturing techniques. The drum 10 is supported for rotation such that its surface moves past a plurality of xerographic processing stations in sequence.

As shown in FIG. 1, initially successive portions of the drum 10 pass through charging station A. At charging station A, a corona discharge device indicated generally by the reference numeral 12, charges the drum 10 to a selectively high uniform potential, V.sub.0. The initial charge decays to a dark decay discharge voltage, V.sub.ddp, (V.sub.CAD).

Figure 3:
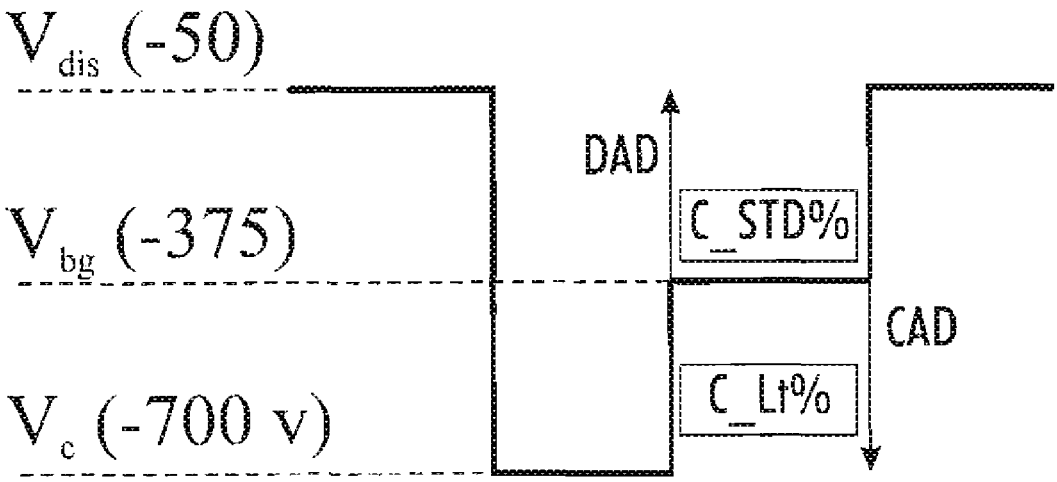
FIG. 3 is a plot of photoreceptor potentials illustrating a tri-level electrostatic image.
Figure 4:
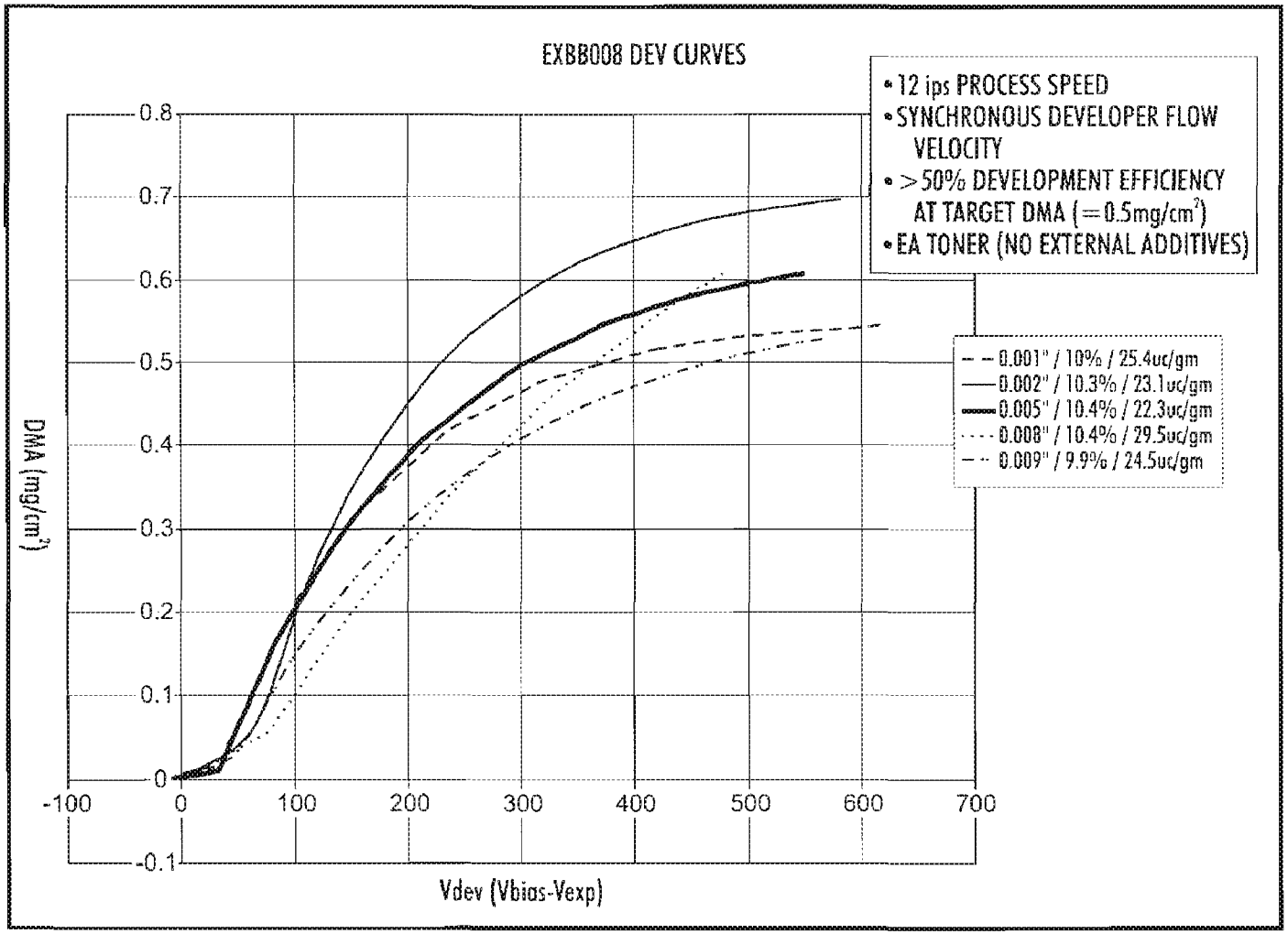
FIG. 4 is a plot of development curves for a non-contact magnetic brush.

Next, the charged portions of the photoreceptor surface are advanced through an exposure station B. At exposure station B, the uniformly charged photoreceptor or charge retentive surface is exposed to a scanning device 48 that causes the charge retentive surface to be discharged in accordance with the output from the scanning device. Preferably the scanning device 48 is a three level laser Raster Output Scanner (ROS), but could be a LED image bar or other known or subsequently developed scanning device 48. Inputs and outputs to and from the ROS 48 are controlled by an Electronic Subsystem (ESS) 50. The ESS may also control the synchronization of the belt movement with the engines 4, 5, 6 and 7 so that toner images are accurately registered with respect to previously transferred images during transfer from the latter to the former. As illustrated in FIG. 3, the photoreceptor, which is initially charged to a voltage V.sub.0, undergoes dark decay to a level V.sub.ddp or V.sub.CAD equal to a predefined voltage, such as −700V, to form CAD images. When exposed at the exposure station B the photoreceptor is discharged to V.sub.0 or V.sub.DAD equal to a lower voltage, such as -50V, to form a DAD image, which is near zero or ground potential in parts of the image. The photoreceptor is also discharged to V.sub.W equal to an intermediate value, such as −375V, in background (white) areas.

At a development station C, a magnetic brush or other development system, indicated generally by the reference numeral 56 advances developer materials, such as toner, into contact with the electrostatic latent images on the photoreceptor. The development system 56 may include two developer units 58 and 60 having magnetic brush developer roll structures.

Each roller advances its respective developer material into contact with the latent image. Appropriate developer biasing is accomplished via power supplies not shown that are electrically connected to respective developer units 58 and 60. Color discrimination in the development of the electrostatic latent image is achieved by passing the photoreceptor past the two developer units 58 and 60 in a single pass with the rollers thereof electrically biased to voltages that are offset from the background voltage V.sub.Mod, the direction of offset depending on the polarity of toner in the housing.

Developer unit 58 in engine 4 uses a first color toner, having triboelectric properties (i.e., negative charge) such that it is driven to the least highly charged areas at the potential V.sub.DAD of the latent images by the electrostatic development field (V.sub.DAD-V.sub.Y bias) between the photoreceptor and the development rolls of unit 58. This roll may be biased using a chopped DC bias via power supply (not shown).

The triboelectric charge of the toner contained in the magnetic brush developer used by the second developer unit 60 in engine 4 is chosen so that a second color toner is deposited on the parts of the latent image at the most highly charged potential V.sub.CAD by the electrostatic development field (V.sub.CAD-V.sub.B bias) existing between the photoreceptor and the developer unit 60. This roll, like the roll of the developer unit 58, may also be biased using a chopped DC bias in which the housing bias applied to the developer housing is alternated between two potentials, one that represents roughly the normal bias for the DAD developer, and the other that represents a bias that is considerably more negative than the normal bias, the former being identified as V.sub.Bias Low and the latter as V.sub.Bias High.

Embodiments of the disclosure employ tri-level imaging as noted above, in which the CAD and DAD developer housing biases are set at a single value that is offset from the background voltage by a suitable value. During image development, a single developer bias voltage is preferably continuously applied to each of the developer units so that the bias for each developer unit has a duty cycle of 100%.

Because the composite image developed on the photoreceptor consists of both positive and negative toner, a negative pretransfer dicorotron member 98 at a pretransfer station is provided to condition the toner for effective transfer to a substrate using positive corona discharge. At a transfer station D, an electrically biased roll 102 contacting the backside of the intermediate belt 1 serves to effect combined electrostatic and pressure transfer of toner images from the photoconductive drum 10 of engine 4 to the belt 1.

A DC power supply 104 of suitable magnitude is provided for biasing the roll 102 to a polarity, in this case negative, so as to electrostatically attract the toner particles from the drum 10 to the belt 1. After the toner images created using engine 4 are transferred from the photoconductive surface of drum 10, the residual toner particles carried by the non-image areas on the photoconductive surface are removed therefrom. These particles are removed at cleaning station E. A cleaning housing 100 supports therewithin two cleaning brushes 132, 134 supported for counter-rotation with respect to the other and each supported in cleaning relationship with photoconductive drum 10. Each brush 132, 134 is generally cylindrical in shape, with a long axis arranged generally parallel to photoconductive drum 10, and transverse to a photoreceptor movement direction 16. Brushes 132, 134 each have a large number of insulative fibers mounted on a base, each base respectively journaled for rotation (driving elements not shown). The brushes 132, 134 are typically detoned using a flicker bar and the toner so removed is transported with air moved by a vacuum source (not shown) through the gap between the housing 100 and photoconductive drum 10, through the insulative fibers and exhausted through a channel, not shown. A typical brush rotation speed is 1300 rpm, and the brush/photoreceptor interference is usually about 2 mm. Brushes 132, 134 beat against flicker bars (not shown) for the release of toner carried by the brushes 132, 134 and for effecting suitable tribo charging of the brush fibers.

Engines 5, 6 and 7 in exemplary embodiments are identical to engine 4, with the exception that the developer units 58, 60 thereof use toners of different colors.

After all of the toner images have been transferred from the engines 4, 5, 6 and 7, the composite image is transferred to a final substrate 150, such as plain paper, by passing through a conventional transfer device 400, which forms a transfer nip with roller 2. The substrate 150 may then be directed to a fuser device 156, such as a heated roll member 158 and a pressure roll member 160, which cooperate to fix the composite toner image to the substrate 150.

The toner images formed on the drum 10 of each of the engines 4, 5, 6 and 7 are effected in the spot next to spot manner, characteristic of the tri-level imaging process and beneficial for achieving excellent color-to-color registration. When transferring toned images to the intermediate belt 1 subsequent to the first image transfer, the transfer is preferably in a color on color (spot on spot) manner when using process colors (CYMK).

Specific details of a first embodiment of the disclosure will be described with reference to FIG. 2. This aspect uses the tri-level process with at least one xerographic imaging unit 4, 5, 6, or 7 containing a pairing of a full strength colorant toner and a reduced strength colorant toner of the same or substantially the same colorant to produce an improved full color image with tighter control over the tone reproduction curve than traditional color development systems.

Figure 2:
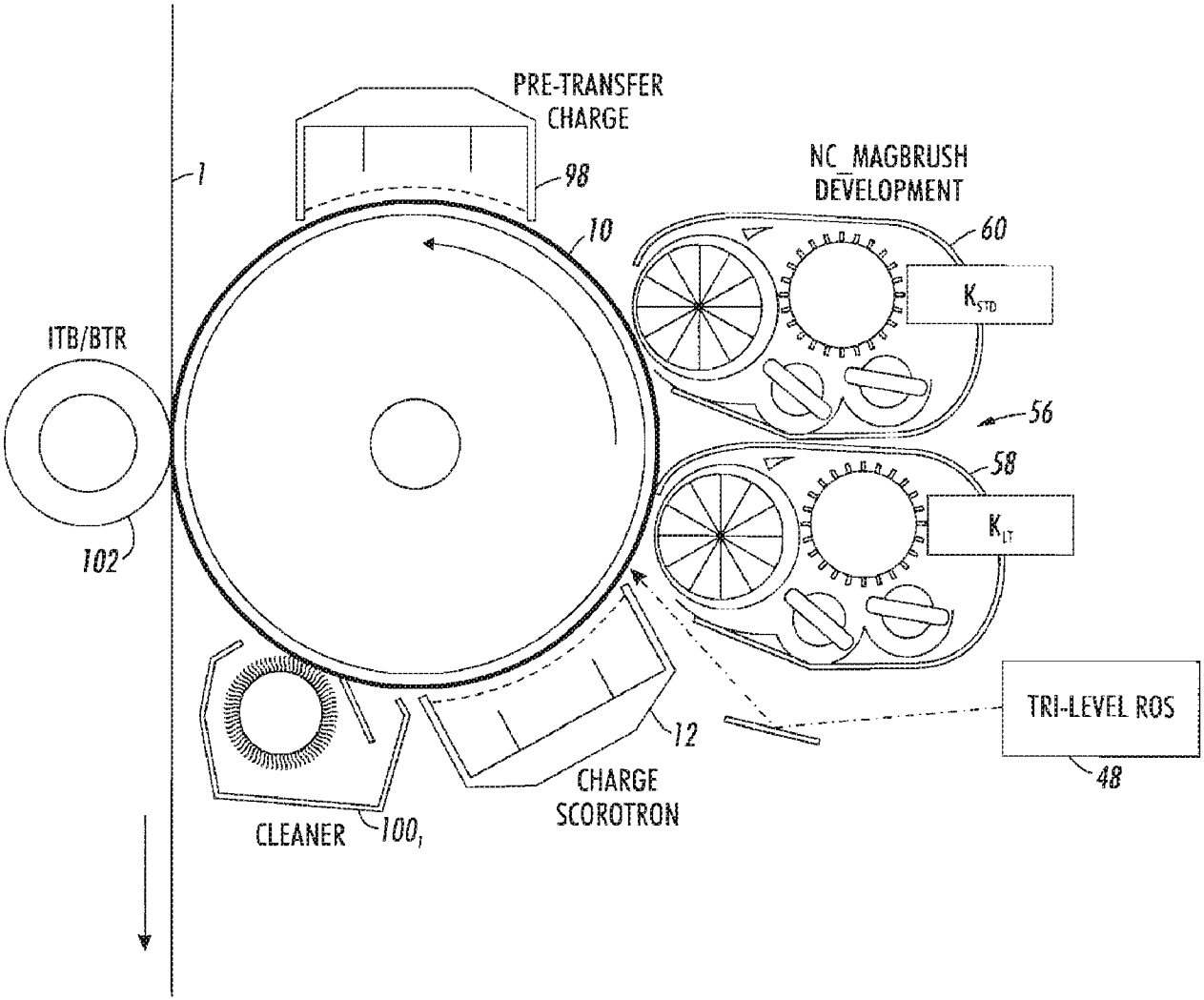
FIG. 2 is an illustration of an exemplary xerographic imaging unit from the system of FIG. 1.
Figure 5:
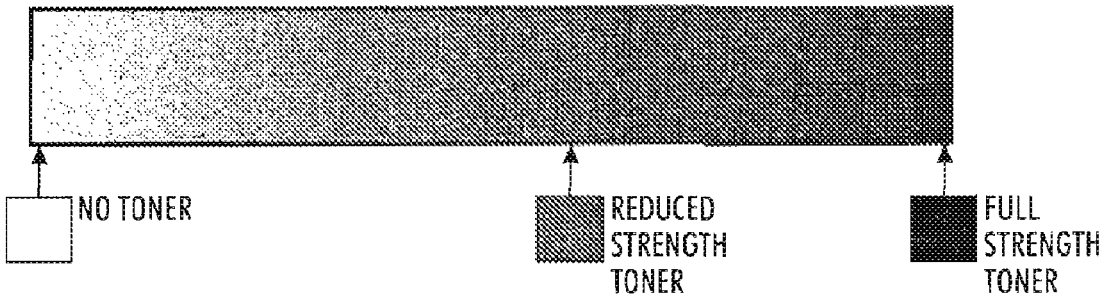
FIG. 5 is an illustration of a graphic showing varied colorant strength black toners used to achieve a full tone reproduction curve (TRC)

In its simplest form, the xerographic machine can be a monochrome copier with a single color capability, having a single photoreceptor, and a single xerographic imaging unit as shown in FIG. 2. The first colorant may be a full strength black toner (K) within a first developer unit of the xerographic imaging unit, such as developer unit 60. The second colorant may be a reduced strength (light) black toner $K_{LT}$ within a second developer unit 58 of the xerographic imaging unit. Because of the tri-level process, perfect registration is enabled between full strength colorant black and reduced strength colorant black. These colorants are intentionally paired together as light and dark strength color components to insure tight control of the tone reproduction curve for each of the separations. For example, as shown in FIG. 5, the full strength colorant is useful for reproducing high density, dark shades of black while the reduced strength light black colorant is useful to reproduce midtones. The process order shown is intentional and can have an advantage because some degree of contamination that could occur for the reduced colorant strength toner migrating downstream to the full strength toner developer unit will pose minimal impact.

Although not shown, the machine may include a microdensitometer and/or a full width array (FWA) for color and/or uniformity monitoring on each of the photoreceptor drums and similar detection on the intermediate belt. In an exemplary embodiment, the photoreceptor may be an 84 mm photoreceptor with components scaled for adequate functionality as known in the art. This may achieve a process speed of in excess of about 300 mm/sec.

As shown in FIG. 3, developers/toners suitable for CAD/DAD processing are used to achieve tri-level development. In the example shown, two strengths of Cyan ($C_{STD}$ and $C_{LT}$) are used. Preferably, the reduced strength colorant ($C_{LT}$) is initially developed in process sequence as a CAD process, followed by the full strength colorant ($C_{STD}$). Voltage levels shown are exemplary, and may be changed depending on the particulars of the machine and developer materials chosen.

As has been practiced in prior tri-level developer products, it is desirable to apply a gentle development process as the secondary development step to minimize interaction with the previously applied toner layer. To achieve this functionality, any of a number of development process options are available. However, as the available development latitude is half that of conventional xerography processes, a highly efficient development approach is desirable to minimize waterfront.

A preferred exemplary development process would include a non-contact magnetic brush development system. This approach should provide low noise development capability due to the reduced interaction. Additionally, it can result in a compact size due to its high development efficiency as demonstrated on various commercial products incorporating such a development system. An exemplary magnetic brush development system can be found in U.S. Pat. No. 6,295,431 to Mashtare, the disclosure of which is hereby incorporated herein by reference in its entirety.

It is preferable that the same development process be applied to all developer units to minimize xerographic development noise and to maintain common component design. Developability data of such a non-contact magnetic brush process can be seen in FIG. 4. From this data, it is apparent that development can be readily achieved for charge/potential values typical for tri-level processes, such as the values shown in FIG. 3. Moreover, such development can be achieved without the need for external additives, which can add to the complexity and cost of the toner. It is envisioned that such a system can achieve processing of 300 mm/sec or more, possibly much higher with optimized hardware and material selection.

As shown by representative FIG. 5, use of a low strength colorant toner to generate a portion of the tone reproduction curve (TRC) for xerography not only provides visual impact advantages through improved image quality, but can provide an inherently more stable performance, particularly in highlight and midtone areas. Process noise sensitivities in xerography are commonly such that instabilities in the low to mid area toner mass coverage result in the most variability in halftone regions, leading to high noise levels, causing image quality problems such as graininess and mottle. However, by applying the reduced strength colorant toner for the various color space separations (such as CYMK), it is possible to develop the highlight and midtone regions with higher toner mass/area (of reduced strength colorant) in a more stable xerographic state. For example, a midtone gray may require about 50% coverage of the full strength black, resulting in a large (50%) area of non-coverage (white) and noise contrast, whereas a reduced strength black may have about a 80-90% area coverage and achieve the same midtone shade, but with less noise or contrast due to the higher mass coverage area. This can be achieved without increasing toner pile height for a full separation TRC. Full strength colorant toners can then be applied to complete the TRC, applying the full strength toner to more visually perceptible, higher contrast regions of the saturated color space. Thus, as depicted in the TRC sweep of FIG. 5, the image rendering path for each separation can be designed to be optimized for reduced image noise and smooth transition by controlling when the reduced strength and full strength toners are applied.

System image path design would involve selection of suitable full strength and reduced strength colorants and selection of combinations at transition states across the TRC. For example, the K-toner for full strength colorant can be produced with about 5% pigment loading, while the reduced strength colorant $K_{LT}$ can have about 1.5% pigment loading. For midlevel L* values, imaging for the two toners can be adjusted to optimize for image smoothness overlapping (via halftone design) these two toner layers. With the inherently perfect color-to-color registration afforded by the tri-level process, no spatial uniformity artifacts are imposed.

Historically, color image next to image (INI) is disadvantageous for color gamut improvement. However, because the INI processing only takes place within each process color separation, the tandem architecture can take advantage of separation overlays to result in improvements in color gamut. Thus, there are additional benefits to use of a tri-level development system using full strength and reduced strength colorants in a tandem architecture.

Known potential problems with typical tri-level processing are adjacency effects that can result in narrow white space between colors (at the transition between CAD/DAD development). However, this white space can be minimized or eliminated through appropriate control of process parameters, including development, AC/DC voltage levels and frequency, and latent image transitions at edges. Advances in modern raster output scanners (ROS) have further potential to improve image quality. Multi-level exposure writing with potential for optimized latent electrostatic image edge profiling can be achieved by the inventive tri-level processing and xerographic machine. Further improvements can be achieved through appropriate selection of small-sized toners, such as 3-5 micron range toner that can lower pile height. This leads to an improved look and feel with reduced fusing temperature requirements and interactive effects.

This basic xerographic machine is not limited to monochrome applications, but can be augmented with one or more additional developer housings and/or xerographic imaging units to achieve spot color, highlight color, custom color, full color, or specialty color printing.

Figure 6:
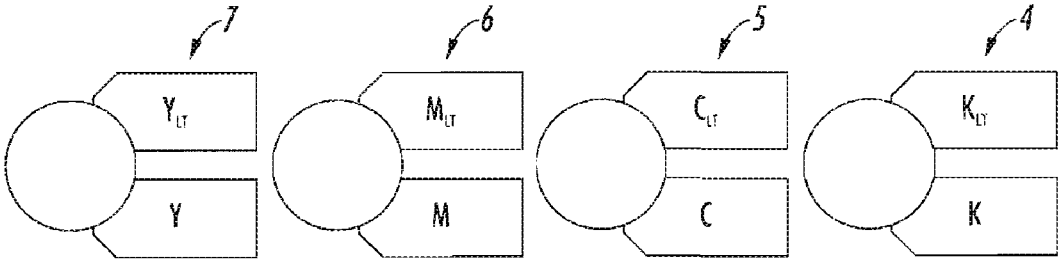
FIG. 6 is an illustration of developer units according to a first embodiment of a 4-drum, 8-color tandem architecture xerographic machine in which the developer units includes a full strength and a reduced strength toner for each of CYMK toners.

In accordance with an exemplary embodiment, the xerographic machine is a full-color, four drum, 8 color tandem architecture device having four xerographic imaging units 4, 5, 6, and 7. Each xerographic imaging unit 4, 5, 6 and 7 includes a single photoreceptor and a tri-level developer unit pair composed of a full strength colorant and a corresponding reduced strength colorant of the same or substantially the same colorant. For example, as shown in FIG. 6, the full strength colorants may be Black (K), Cyan (C), Magenta (M), and Yellow (Y), with corresponding reduced strength colorants $K_{LT}$, $C_{LT}$, $M_{LT}$, and $Y_{LT}$.

Figure 7:
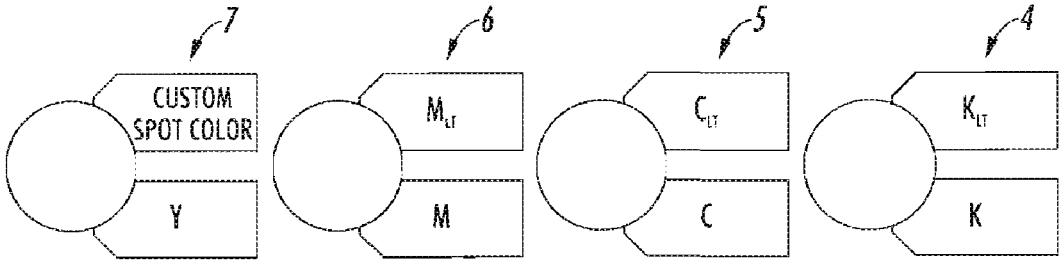
FIG. 7 is an illustration of developer units according to a second, alternative embodiment of a 4-drum, 8-color tandem architecture xerographic machine in which CMK developer units include a full strength and a reduced strength toner and the Y developer unit includes a yellow toner and a custom spot color.
Figure 8:
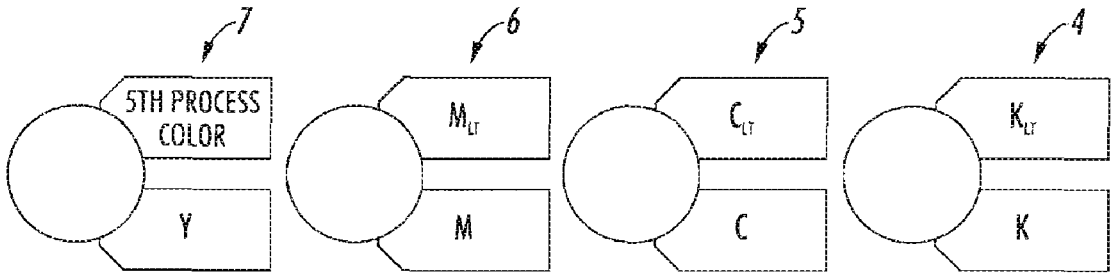
FIG. 8 is an illustration of developer units according to a third, alternative embodiment of a 4-drum, 8-color tandem architecture xerographic machine in which CMK developer units include a full strength and a reduced strength toner and the Y developer unit includes a yellow toner and a $5^{th}$ process color.
Figure 9:
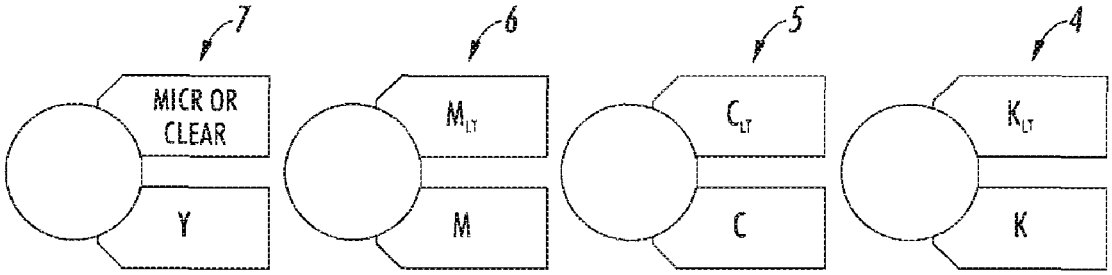
FIG. 9 is an illustration of developer units according to a fourth, alternative embodiment of a 4-drum, 8-color tandem architecture xerographic machine in which CMK developer units include a full strength and a reduced strength toner and the Y developer unit include a yellow toner and a specialty toner, such as clear toner or MICR toner or white pigmented toner.

However, various other possibilities and combinations exist. For example, because yellow already is a light density colorant, it may not be necessary to provide a reduced strength yellow colorant. Accordingly, this extra developer unit could be replaced with another colorant. For example, the developer unit could be filled with a custom spot color, such as Pantone Red 032, for example, as shown in FIG. 7, or a fifth process color, such as orange, as shown in FIG. 8 to increase the gamut. Alternatively, the extra developer unit can be replaced with a specialty colorant, such as a clear toner with a gloss or matte finish, or a MICR magnetic toner or a white pigmented toner as shown in FIG. 9.

Figure 10:
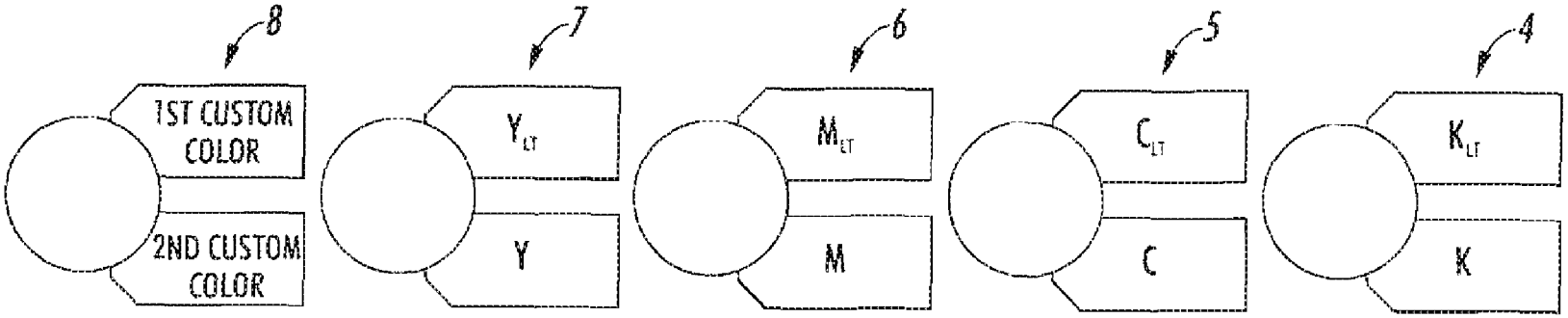
FIG. 10 is an illustration of developer units according to a fifth, alternative embodiment of a 5-drum, 10-color tandem architecture xerographic machine that includes the four developer units of FIG. 6 and a fifth developer unit including a first and second custom color.

Additionally, other architectures are possible and the machine is not limited to four xerographic imaging units. Instead, as illustrated in FIG. 10, a five drum, 10 color tandem architecture could be used to accommodate two custom spot colors or any other colors to dramatically increase color gamut potential while minimizing footprint size. The fifth xerographic imaging unit 8 could be another tri-level process xerographic imaging unit. Additionally, the tri-level process xerographic imaging units may be combined in a tandem architecture with more conventional xerographic imaging units. This may be the case where full xerographic system latitude is required or preferred.

It will be appreciated that various of the above-disclosed and other features and functions, or alternatives thereof, may be desirably combined into many other different systems or applications. For example, with suitable efficient design and photoreceptors, these disclosed architectures could provide viable digital production color copiers capable of improved graphic image quality and gamut and may be suitable for use in tightly integrated parallel printing (TIPP) system platforms. Also, various presently unforeseen or unanticipated alternatives, modifications, variations or improvements therein may be subsequently made by those skilled in the art, and are also intended to be encompassed by the following claims.

What is claimed is:

1. A xerographic printing method, comprising:

uniformly charging a photoreceptor of a first tri-level xerographic imaging unit to a predetermined voltage;

creating tri-level electrostatic images including CAD image areas and DAD image areas having different voltage levels, respectively on the photoreceptor;

developing the CAD image areas and DAD image areas with a first full strength toner of a first color and a first reduced strength toner of substantially the same first color to form a first composite separation image of a desired image;

transferring the first composite separation image onto a substrate.

2. The xerographic printing method of claim 1, wherein the first color is selected from Cyan (C), Yellow (Y), Magenta (M) and Black (K).

3. The xerographic printing method of claim 1, wherein at least two xerographic imaging units are used, the second xerographic imaging unit including a second toner of a color different from the first toner.

4. The xerographic printing method of claim 3, wherein the second toner includes at least one of a spot color, a custom color, and a specialty color.

5. The xerographic printing method of claim 1, wherein the first reduced strength toner is developed prior to the first full strength toner.

6. A xerographic printing method, comprising:

uniformly charging a photoreceptor of a first tri-level xerographic imaging unit to a predetermined voltage;

creating tri-level electrostatic images including CAD image areas and DAD image areas having different voltage levels, respectively;

developing the CAD image areas and DAD image areas with a first full strength toner of a first color and a first reduced strength toner of substantially the same first color to form a first composite separation image of a desired image;

transferring the first composite separation image onto an intermediate transfer member;

uniformly charging a photoreceptor of a second tri-level xerographic imaging unit to a predetermined voltage;

creating tri-level electrostatic images including CAD image areas and DAD image areas having different voltage levels, respectively on the photoreceptor of the second xerographic imaging unit;

developing the CAD image areas and DAD image areas with a second full strength toner of a second color differing from the first toner and a second reduced strength toner of substantially the same second color to form a second composite separation image of a desired image;

forming a desired image by transferring the second composite separation image onto the intermediate transfer member in registration with the first composite separation image; and transferring the desired image from the intermediate transfer member onto a substrate.

7. The method according to claim 6, wherein at least four xerographic imaging units are provided, each including a different one of Cyan (C), Yellow (Y), Magenta (M) and Black (K) full strength colorant toner, and at least two of the xerographic imaging units include a reduced strength colorant.

8. The method according to claim 6, wherein at least one xerographic imaging unit includes one of a spot color, a custom color, a different process color, and a specialty color colorant.

9. A xerographic machine, comprising:

a first photoreceptor; and a tri-level xerographic imaging unit including a charging device for charging the first photoreceptor to a predetermined voltage;

an imaging system for obtaining hi-level electrostatic images including CAD image areas and DAD image areas on the first photoreceptor; and first and second developer units for developing the CAD image areas and the DAD imaging areas with a first full strength colorant toner of a first color from one of the developer units and a first reduced strength colorant toner of substantially the same first color from the other of the developer units, wherein one of the toners is developed in the CAD image areas and the other toner is developed in the DAD image areas to form a first composite color separation of a desired image.

10. The xerographic machine according to claim 9, wherein the first colorant toner is selected from Cyan (C), Yellow (Y), Magenta (M) and Black (K).

11. The xerographic machine according to claim 9, wherein at least two xerographic imaging units are used, the second xerographic imaging unit being associated with a second photoreceptor and including a second toner of a color different from the first toner.

12. The xerographic machine according to claim 11, wherein the second toner includes at least one of a spot color, a custom color, and a specialty color.

13. A xerographic machine, comprising:

a first photoreceptor associated with a first tri-level xerographic imaging unit including a charging device for charging the first photoreceptor to a predetermined voltage;

a ROS for obtaining tri-level electrostatic images including CAD image areas and DAD image areas on the first photoreceptor; and first and second developer units for developing the CAD image areas and the DAD image areas with a first full strength colorant toner of a first color from one of the developer units and a first reduced strength colorant toner of substantially the same first color from the other of the developer units, wherein one of the toners is developed in the CAD image areas and the other toner is developed in the DAD image areas to form a first composite color separation of a desired image on the first photoreceptor;

a second photoreceptor associated with a second tri-level xerographic imaging unit including a charging device for charging the second photoreceptor to a predetermined voltage;

a ROS for obtaining tri-level electrostatic images including CAD image areas and DAD image areas on the second photoreceptor; and third and fourth developer units for developing the CAD image areas and the DAD image areas with a second full strength colorant toner of a first color from one of the third and fourth developer units and a second reduced strength colorant toner of substantially the same second color from the other of the third and fourth developer units, wherein one of the toners is developed in the CAD image areas and the other toner is developed in the DAD image areas to form a second composite color separation of a desired image on the second photoreceptor; and a transfer member that transfers the first and second color separations in registration onto an intermediate transfer member.

14. The xerographic machine according to claim 13, wherein at least four xerographic imaging units are provided, each including a different one of Cyan (C), Yellow (Y), Magenta (M) and Black (K) full strength colorant toner, and at least two of the xerographic imaging units include a reduced strength colorant.

15. The xerographic machine according to claim 14, wherein the first xerographic imaging unit includes a full strength Black (K) toner colorant and a reduced strength Black toner colorant ($K_{LT}$), the second xerographic imaging unit includes a full strength Cyan (C) toner colorant and a reduced strength Cyan toner colorant ($C_{LT}$), the third xerographic imaging unit includes a full strength Magenta (M) toner colorant and a reduced strength Magenta ($M_{LT}$) toner colorant, and the fourth xerographic imaging unit includes a full strength Yellow (Y) colorant and a colorant of a different color.

16. The xerographic machine according to claim 15, wherein the different color is one of a custom spot color, a fifth process color, or a specialty color.

17. The xerographic machine according to claim 14, further comprising a fifth xerographic imaging unit containing yet another different color.

18. The xerographic machine according to claim 17, wherein the fifth xerographic imaging unit is a tri-level xerographic imaging unit.

19. The xerographic machine according to claim 13, wherein at least one xerographic imaging unit includes one of a spot color, a custom color, a different process color, and a specialty color colorant.

20. The xerographic machine according to claim 13, wherein a developer unit housing the reduced strength colorant is oriented relative to a process direction so that the reduced strength toner is developed prior to the full strength toner.

* * * * *